US010777172B1

(12) United States Patent
Katzenberger

(10) Patent No.: US 10,777,172 B1
(45) Date of Patent: Sep. 15, 2020

(54) FOLDED HORN ACOUSTIC GUITAR

(71) Applicant: Joseph J. Katzenberger, Crawfordsville, IN (US)

(72) Inventor: Joseph J. Katzenberger, Crawfordsville, IN (US)

(73) Assignee: Joseph J. Katzenberger, Crawfordsville, IN (US)

( * ) Notice: Subject to any disclaimer, the term of this patent is extended or adjusted under 35 U.S.C. 154(b) by 0 days.

(21) Appl. No.: 16/431,553

(22) Filed: Jun. 4, 2019

(51) Int. Cl.
*G10D 13/02* (2020.01)
*G10D 3/02* (2006.01)
*G10D 1/08* (2006.01)

(52) U.S. Cl.
CPC ..... *G10D 3/02* (2013.01); *G10D 1/08* (2013.01)

(58) Field of Classification Search
CPC ..... G10D 3/02; G10D 1/08
See application file for complete search history.

(56) References Cited

U.S. PATENT DOCUMENTS

| | | | |
|---|---|---|---|
| 2,001,723 | A | 5/1935 | Hammond, Jr. |
| 2,228,463 | A | 6/1942 | Kislingbury |
| 3,194,870 | A | 7/1965 | Tondreau et al. |
| 3,549,775 | A | 12/1970 | Kaminsky |
| 3,612,741 | A | 10/1971 | Marshall |
| 3,656,395 | A | 4/1972 | Kaman |
| 3,892,159 | A | 7/1975 | Houstma |
| 4,464,967 | A | 8/1984 | Trimborn |
| 4,748,886 | A | 6/1988 | De Byl |
| 4,987,815 | A | 1/1991 | Shockley |
| 5,208,410 | A | 5/1993 | Foley |
| 5,333,527 | A | 8/1994 | Janes |
| 5,461,958 | A | 1/1995 | Dresdner |
| 5,442,986 | A | 8/1995 | Cota |
| 5,549,027 | A | 8/1996 | Steinberger |
| 5,567,896 | A | 10/1996 | Gottschall |
| 5,661,252 | A | 8/1997 | Krawczak |
| 5,682,003 | A | 10/1997 | Jarowsky |
| 4,995,293 | A | 11/1999 | Anderson |
| 6,040,510 | A | 3/2000 | Yuan |
| 6,124,536 | A | 9/2000 | Hoshino |
| 6,646,191 | B1 | 11/2003 | Martin |
| 6,664,452 | B1 | 12/2003 | Teel |
| 6,800,797 | B2 | 10/2004 | Steiger |
| 6,833,501 | B2 | 12/2004 | Jagmin |

(Continued)

OTHER PUBLICATIONS

U.S. Appl. No. 10/686,839, filed Oct. 14, 2003, Henry Langeman.
U.S. Appl. No. 11/142,487, filed Jun. 1, 2005, Kenneth Preece.
U.S. 11/810,948, filed Sep. 7, 2007, Jan Anders Linden.

*Primary Examiner* — Kimberly R Lockett

(57) ABSTRACT

This invention is an acoustic guitar with two internal folded horns built into the guitar body. Each left and right horn is five feet long. The natural acoustic sound inside the guitar is captured by a microphone (not a pickup under the strings), inside the guitar's upper chamber. It is then sent to an internal preamp, which sends the signal to left and right speakers, which are mounted to the compression chamber at the start of each folded horn. It then travels through the throat of each folded horn, which increases exponentially until it reaches the end of the horn. The sound waves are concentrated throughout this shape (does not lose sound energy), and are also directed to left and right exits out the end of the instrument. The material for the body is Rock Maple, and the other materials are Sitka Spruce, Rosewood and Mahogany.

6 Claims, 5 Drawing Sheets

(56) References Cited

U.S. PATENT DOCUMENTS

| | | | |
|---|---|---|---|
| 7,019,202 | B1 | 3/2006 | Hetzel |
| 7,446,247 | B2 | 11/2008 | Shellhammer |
| 7,671,268 | B2 | 3/2010 | Nicoll |
| 9,305,527 | B2 | 4/2016 | Dwylitis |

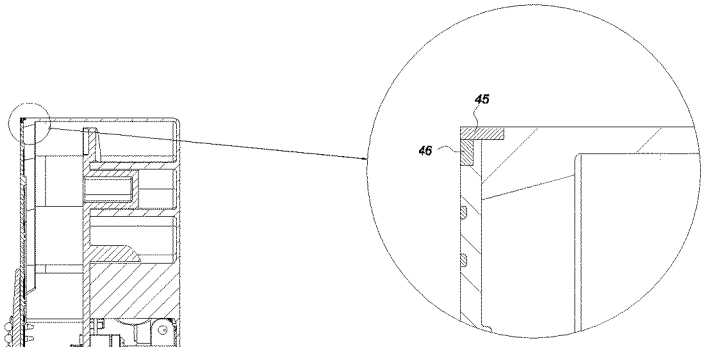
FIG. 3
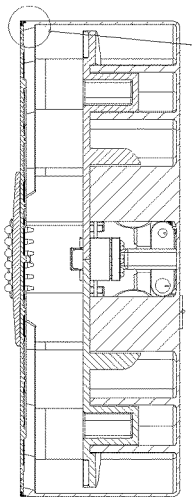
FIG. 4
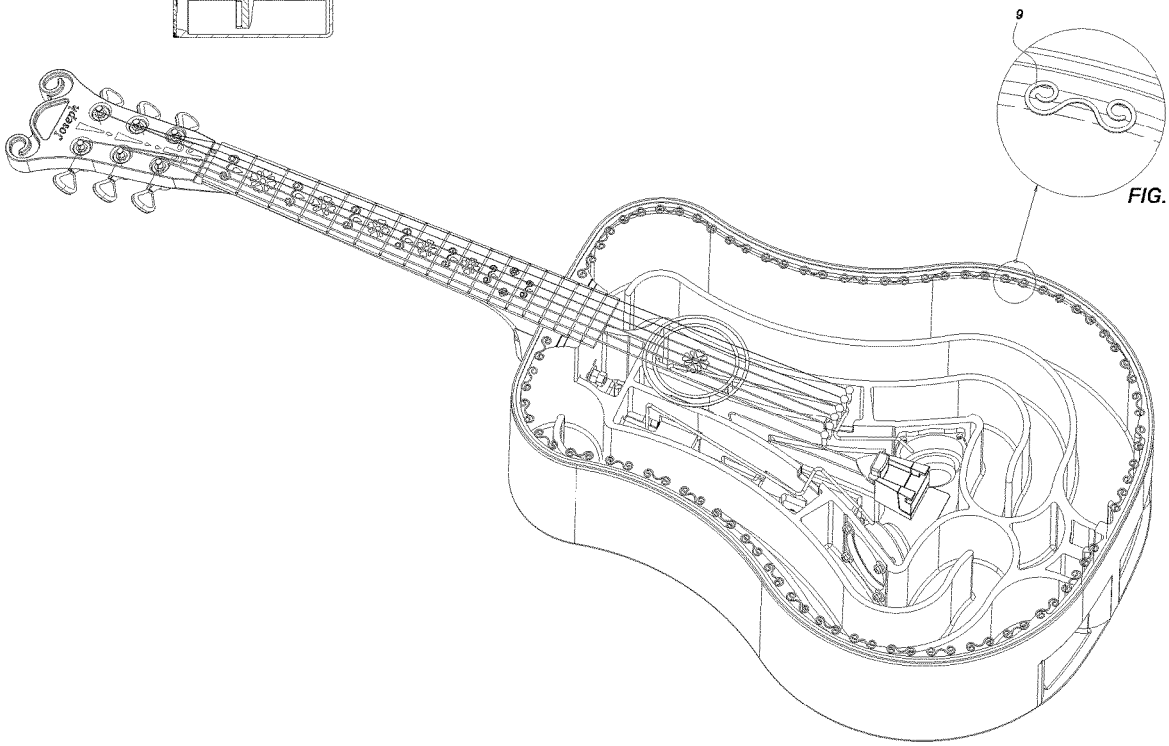
FIG. 2
FIG. 1

FOLDED HORN ACOUSTIC GUITAR

BACKGROUND OF INVENTION

This solves the problem of an acoustic guitar not having enough volume (or related beautiful tone due to this), in an acoustic environment, especially with other instruments. Classical guitars are not, and generally never have been included as a standard instrument in a symphony orchestra, due to lack of volume. Listen to an acoustic guitar being played with a violin, a piano, a banjo, and/or any brass instrument. The acoustic guitar can't be heard well, in an acoustic environment with other acoustic instruments. You can hear it within ten feet of the music. At twenty feet, thirty feet, and more, these other acoustic instruments can all be heard easily, but the acoustic guitar sound is greatly reduced. Other products include an acoustic/electric guitar that can be plugged into an amplifier. This type of guitar uses a pickup under the strings, does not capture the true acoustic sound of the guitar, and does not enhance the sound in any way (folded horn or other). Acoustic/electric guitars are not meant to be played through guitar amplifiers, which are made for electric guitars (some amps are made for acoustic guitars, which are much better). The closest alternative is using an acoustic guitar with a high end microphone into a public address system (more on this later). My product is made to produce an acoustic, pure, beautiful sound, not needing external amplification or an electrical source (battery powered). That said, an external amplifier can be used, all options are included in this design.

The folded horns are inside the acoustic guitar, and can't be seen (except horn exits on the end of the instrument). The guitar does not look any different from a standard acoustic guitar on the outside, other than the soundboard is three inches larger (longer) than a standard dreadnought guitar. It is radically different on the inside. It is heavier, so this difference will be noticed when the guitar is held. It is similar in weight to a heavy solid body electric guitar (classic older Gibson Les Paul). The guitar body is manufactured from high quality Rock Maple available online (two 3"×18"×24" pieces laminated together). This will allow machining of the back and sides from one solid piece of material to form the guitar body, which we need for the unusual body shape/folded horn design, and also to minimize cost without affecting quality. The folded horns grow exponentially, and are somewhat similar in shape to a Saxophone, but the material is Rock Maple. This guitar has an upper and lower internal chamber. The chamber divider itself contains the gradual (exponential) horn shape, and is assembled into the horn channel in the lower chamber. Everything above the chamber divider is the upper chamber. This is where the microphone is placed, to capture the true acoustic sound of the guitar. The only way this can be manufactured is with computer numerical control programming and machining. A Luthier with standard guitar building tools can't build this guitar completely. That said, a Luthier is required to fit, hand work and assemble this guitar, to assure the highest levels of quality. This is a true combination of technology and craftsmanship. The goal is to build an acoustic guitar with increased volume, so the guitar player can easily play/vibrate the strings, resulting in a beautiful rich tone, not degraded by excessive force on the strings. The folded horn greatly contributes to superior sound due to concentrated sound waves. This produces a beautiful sound without losing sound wave energy, and increasing sound wave direction as it exits the guitar. It should be noted that all sound normally generated from the body of the guitar remains, and is actually enhanced due to the larger soundboard. This is all possible while being UNPLUGGED.

Other innovations include a thin and light (yet strong) soundboard. This projects more sound, due to increased soundboard vibration. This is achieved by cutting the soundboard from a solid piece of wood, and not gluing braces by the traditional method. Decorative features on top of the soundboard are disguised as features that provide flexibility to the soundboard, without losing strength (due to the unique design that does not contain any sharp corners).

To maintain strength and provide musical sustain, the neck is dovetailed, screwed and doweled to the body. This is possible due to the solid back and sides. The finger board is cut short on the soundboard (by four frets), to allow more soundboard vibration. These frets are rarely used on an acoustic guitar, so this is an improvement. The traditional truss rod to adjust the neck is included in this design.

The Bridge is also longer, and provides more vibration to the soundboard. This is possible, because the underside of the bride is relieved (cut away). This allows more contact over a greater length with the soundboard, but does not increase the actual square inch contact area by a great amount.

String height (action), is completely different and improved. Almost all acoustic guitars have a fixed nut and fixed saddle. While the saddle can be adjusted with shims, this is not effective to adjust action. String height is very important, as it affects tone, string noise (buzz), and the ability to play with less effort. It also affects the ability to play slide guitar, which is a great technique on the acoustic guitar. The nut is recessed into a pocket, which allows it to be free standing, and adjustable. This is achieved by suppling ten different nut components, all of different height. There are also ten different saddle components, all of different height. The combination of these different nut and saddle heights allows string action adjustment never seen before.

Finally, as mentioned earlier, this guitar has been completely prototyped as a virtual design (complete digital 3D computer aided design, available for view upon request). After the utility patent has been granted, this design will be available on the internet, to receive input from many people. This can help determine who may be interested in building this guitar, who may provide improvements, and who might develop improved ideas for their own designs and patents. The goal is to license this idea to people that understand guitar building, (but they must have the computer numerical equipment to handle this project). It should be noted that I am a music lover, and hope to spread this idea to others, after first protecting myself legally.

SUMMARY OF INVENTION

As described above, this invention is an acoustic guitar that produces higher volume and improved tone, while being played with much less effort (less distortion). This can be achieved with two AA batteries, which makes this a guitar that can be played anywhere, without the need for electrical power and equipment. Guitar players all over the world love to pick up a guitar and play anywhere. They also want to control the volume without cumbersome electrical equipment. This guitar can be played inside or outside at any time. Acoustic guitars with pickups underneath the strings sound inferior, people put up with this because the alternative of special equipment is not desired (especially if one is not a professional musician, which most people who play the guitar are not). PLEASE NOTE: If the USPTO would like to see this design assembly as a full 3-D model, STEP files or Parasolid files are available to read into your 3D CAD system. Please request if this is needed, I would be happy to supply, and you would have a much easier time reviewing this project.

DRAWINGS OF INVENTION

All manufactured components of this instrument are completely detailed in drawings, and are available for review. This product is modeled in a 3D CAD system for design and computer controlled manufacturing. 100% of all components are included, right down to mother of pearl inlay. All components can be programmed from this solid model for manufacturing. This project considers design for manufacturing (DFM) methods, to eliminate redesign for manufacturing. That said, this guitar has been redesigned many times, due to research and developments efforts.

BRIEF DESCRIPTION OF THE DRAWINGS

FIG. 1—Complete assembly with light yet strong soundboard removed (sheet 1).

FIGS. 2—4× scale mother of pearl for decoration, to increase vibration of soundboard (sheet 1).

FIGS. 3—10× scale herringbone trim and white purfling detail (sheet 1).

FIG. 4—Section 4-4 from sheet 2 FIG. 5 (sheet 1).

FIG. 5—Top view (sheet 2).

FIG. 6—Front view from FIG. 5 (sheet 2).

FIG. 7—Section 7-7 from FIG. 5 (sheet 2).

FIG. 8—Light yet strong soundboard top perspective view, which is missing from FIG. 1 for clarity (sheet 3).

FIG. 9—Light yet strong soundboard bottom perspective view, which is flipped 180 degrees from FIG. 8 (sheet 3).

FIG. 10—Electronics assembly bottom perspective view from FIG. 1 (sheet 3).

DETAILED DESCRIPTION

Figure 5:
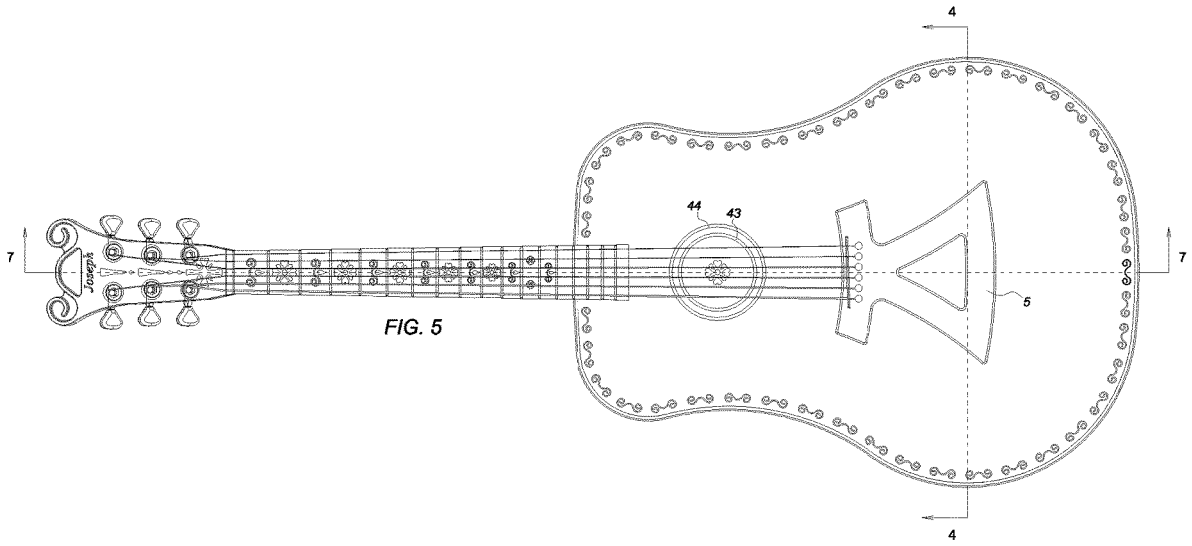

Referring now to the drawings: FIG. 1 illustrates an acoustic guitar with a back, and a side, all machined from a solid piece of wood to form a guitar body 2, (two 3"×18"×24" laminated maple blocks joined by bonded adhesive, (Michigan Maple Block Petoskey, Mich.). This includes two internal folded horns, built into the guitar body 2, which are machined into this solid piece using the well-known computer numerical controlled machining process. All components have been reviewed for DFM (design for manufacturing), so the machining process does not have any unknown complications. The light yet strong soundboard 1 is not shown for clarity, the neck 3, is shown connected to the guitar body 2, and also connected to the fingerboard 4. These and all other components, are shown in greater detail in additional FIGURES for clarity. Note that six strings are shown, which should be light gage, to avoid excessive force on soundboard. These are standard strings that can be purchased at any music store, and are installed the same as any other acoustic guitar.

FIG. 2 shows forty two pieces of mother of pearl inlay 9, around entire perimeter of soundboard. The blind cuts in the light yet strong soundboard 1 have no sharp corners, and are disguised with this decoration, but are needed in the design primarily to allow the light yet strong soundboard 1 to vibrate more freely, which moves more air mass, which provides more volume. These blind cuts can be filled with mother of pearl, but this is optional. They are functional either way.

FIG. 3 shows 45 perfling (side trim) around entire perimeter of the guitar body 2, and 46 herringbone trim around entire perimeter of light yet strong soundboard 1. Note that light yet strong soundboard 1 is attached to the guitar body 2 with wood adhesive. The guitar body 2 can have material removed where light yet strong soundboard 1 is held in place with adhesive, if required. This can allow more light yet strong soundboard 1 vibration, and greater volume.

Figure 10:
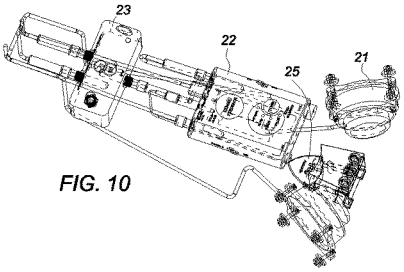

FIG. 4 (section 4-4 from sheet 2, FIG. 5) shows overall width of guitar, and also provides direction for FIG. 3 10× scale view.

FIG. 5 shows the top view assembly of the guitar, which section A-A and section B-B are taken from. It also shows 43 rosette inner, and 44 rosette outer. These are blind pockets, and are only decorative. More importantly, the bridge 5, is shown. This is a large bridge, attached to the light yet strong soundboard 1, to assist in greater vibration of light yet strong soundboard 1. If this is proved to be detrimental, the bridge is "wood safe" meaning large enough to reduce easily if required.

Figure 6:
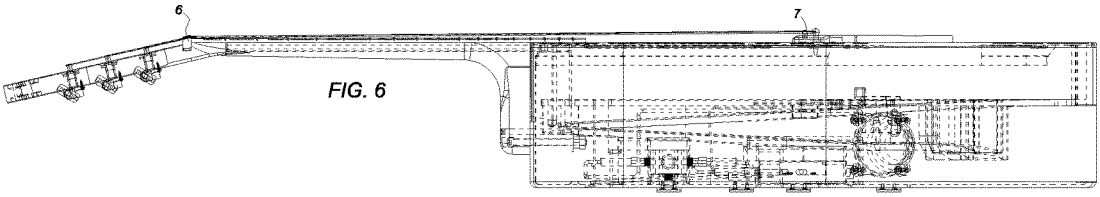
Figure 14:
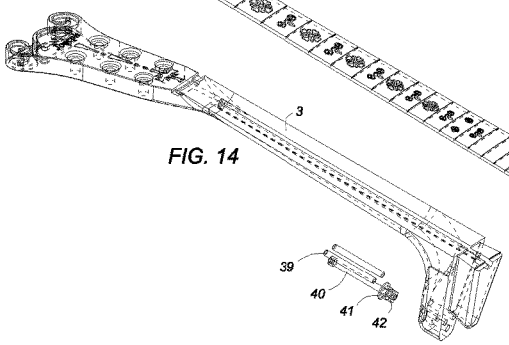
FIG. 14—Neck assembly top perspective view from FIG. 1 (sheet 4).

FIG. 6, which is a front view from FIG. 5, shows the adjustable saddle 7, pocketed into the bridge 5, and the adjustable nut 6, pocketed into the neck 3, so they do not need to be held in place by adhesive (see FIG. 1 and FIG. 14). This allows the action of the strings to be set from both ends of the guitar, which offers far more action settings. The nut 6 and saddle 7 can be adjusted with multiple sizes of nuts 6, and saddles 7 provided (ten each).

Figure 7:
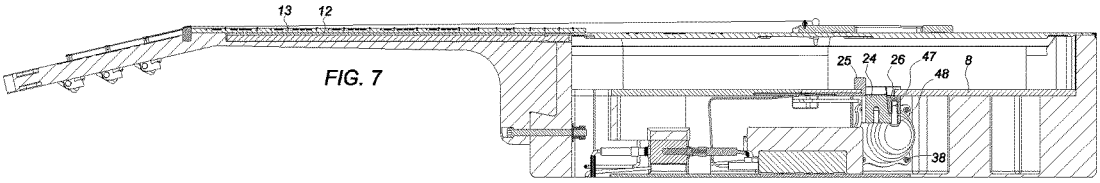

FIG. 7, which is section 7-7 from FIG. 5, shows truss rod 12 (14½" truss rod marketed by Bitterroot Guitars of Door, Mich.), and seventeen frets 13. These are standard components in any acoustic guitar. The truss rod 12, is set inside of neck 3, and allows for adjustment of neck 3, to keep it straight. The frets allow for precise fingering, and correct pitch of the strings. This also shows chamber dividers 8, 18, 19 and 20. This is a four piece assembly that forms the chamber, throat and exponentially growing folded horn, when assembled with the guitar body 2. This also shows the microphone locating device center wedge 24, which helps locate the iRig Acoustics Stage Omnidirectional Digital MEMS Microphone 25 (Serial number INA01-65HFAIT1-91344, marketed by IK Multimedia of Sunrise, Fla.). The microphone locating device end 26, also locates the above microphone 25. The three button head cap screws for microphone mounting 47, attaches the above microphone 25, to the chamber dividers 8, 18, 19 and 20, including three steel washers 48, to assist in mounting above microphone 25. Also eight socket head cap screw/washer/nut sets for speaker 38, attaches Full-Range Speaker 21 (Part number TEBM406C20N-4B BMR 3 marketed by Tectonic Elements Woodinville, Wash.—two required) to the guitar body 2.

Figure 8:
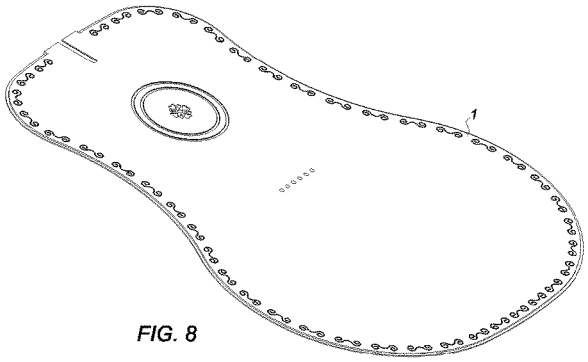

FIG. 8 shows light yet strong soundboard 1 top perspective view. This was omitted from FIG. 1 for clarity.

Figure 9:
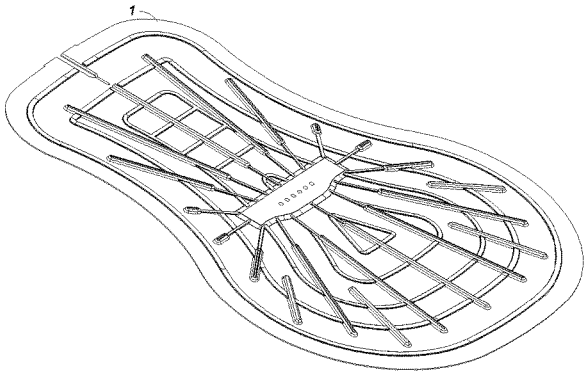

FIG. 9 shows light yet strong soundboard 1 bottom perspective view (flipped 180 degrees from FIG. 8). This was omitted from FIG. 1 for clarity.

FIG. 10 is the electronics assembly bottom perspective view (from FIG. 1). This shows speaker 21, and also microphone 25. These are both shown again in this view for clarity. Also shown is 22, iRig Acoustic Stage Digital Sound Processor Preamp (Serial number INA01-65HFAIT1-91344 marketed by IK Multimedia of Sunrise, Fla.). Another component shown is 23, JHS Mini A-B Box 2 Channel Line Switcher (marketed by JHS Pedals of Grandview, Mo.). These components, and their connections to other parts, are noted in greater detail in FIG. 12.

Figure 11:
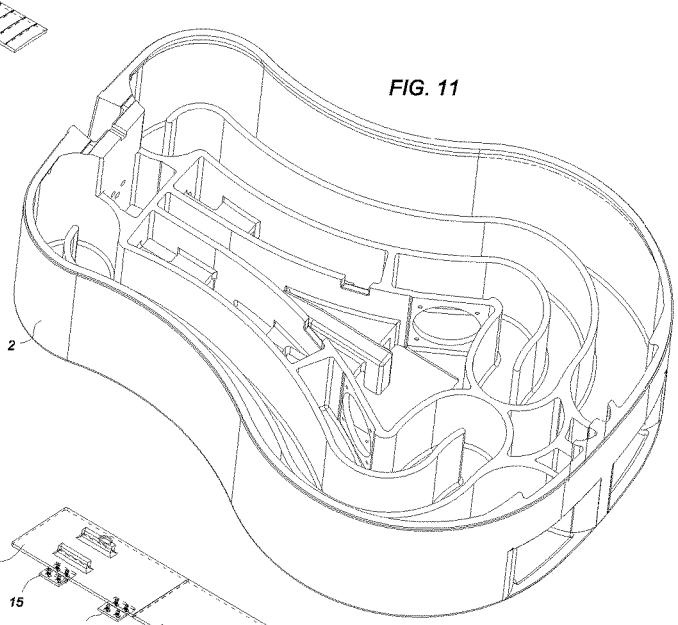
FIG. 11—Guitar body top perspective view from FIG. 1 (sheet 4).

FIG. 11 shows the guitar body 2 top perspective view (from FIG. 1) without other components for clarity.

Figure 12:
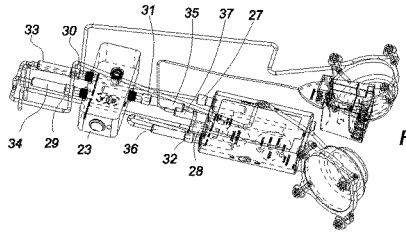
FIG. 12—Electronics assembly top perspective view from FIG. 1 (sheet 4).

FIG. 12 shows 32, standard ¼" male input and ⅛" female output connector, which connects to 36, ⅛" male output to ⅛" male input connector (shown as detail 35, for clarity, but this is the same component). This connects to 31, ⅛" female connector to ¼" male connector, which connects to 23 JHS Mini A-B Box 2 Channel Line Switcher (marketed by JHS Pedals of Grandview, Mo.).

The iRig preamp 22, inside the guitar, has an optional input 27 that can be used for vocals. An optional battery powered microphone (used with an ear mount for the guitar player) can be plugged into this optional input. This allows the guitar and vocals to be output from the internal guitar speakers. This input 27 can also be used with an iPhone, CD player or any other device that can connect to this jack (with off the shelf connectors that are not included). This allows the guitar player to play along with their favorite music if desired.

There is also a USB port available on the iRig preamp 22 as an output 28, to record music to an iPhone, computer, or any other device required (with off the shelf connectors).

Also shown is 37, standard 3.5 mm male input shown for clarity, this is actually the connector end of microphone 25.

Also shown is 30, standard ¼" male input and ⅛" female output connector. This connects 23 JHS Mini A-B Box to 33, standard ⅛" male connector with a standard wire that splits into two wires. This connects to left and right speaker 21, which is the final electronic output signal. The acoustic sound wave then moves through left and right folded horns, as described in the "Abstract" and "Background of Invention". These sound waves lose very little sound energy. They exit the end of the folded horns with greater volume and exceptional tone, due to moving through the Rock Maple folded horn only. The actual folded horn "space" is created by the assembly of the guitar body 2, and chamber dividers 8, 18, 19 and 20.

Also shown is 29, standard ¼" male input and ⅛" female output connector. This can connect to 34, standard ⅛" male connector, which allows output from the guitar that bypasses the internal electronics if desired. This can provide output to an iPhone, iPad, PA system, acoustic guitar amp, electric guitar amp, mixer, or any other device. The 23 JHS Mini A-B Box, shown above, has a push button that allows these options. This is easily accessible through hinged back cover 10 and 17.

If this alternative connection is used, or if no electrical connection is used, this acoustic guitar still provides a louder sound, due to the larger and thinner light yet strong soundboard.

Figure 13:
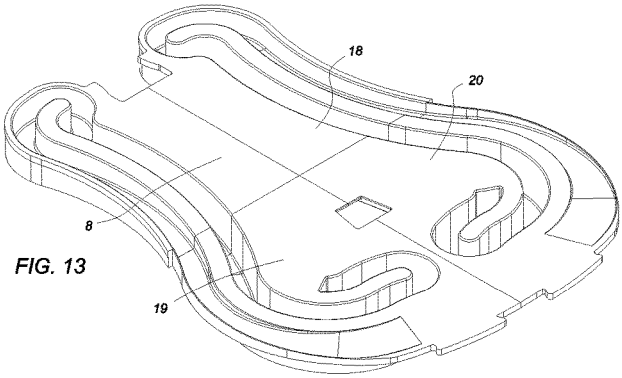
FIG. 13—Four piece chamber dividers top perspective view from FIG. 1 (sheet 4).

FIG. 13 shows top perspective view of chamber dividers 8, 18, 19 and 20 without other components for clarity.

FIG. 14 shows top perspective view of neck 3. It also shows two steel dowels 39, socket head cap screw 40, steel washer 41, and lock nut 42, which all connect the neck 3, to the guitar body 2.

Figure 15:
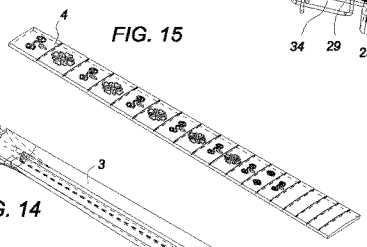
FIG. 15—Fingerboard top perspective view from FIG. 1 (sheet 4).

FIG. 15 (from FIG. 1) shows top perspective view of fingerboard 4 without other components for clarity.

Figure 16:
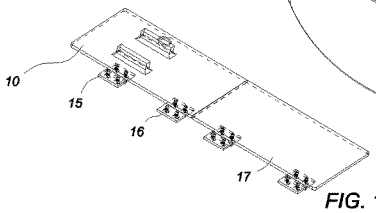
FIG. 16—Back covers top perspective view from FIG. 1 (sheet 4).

FIG. 16 (from FIG. 1), shows top perspective view of back cover 10 and 17. Also shown is Horton Box Hinge 15 (Part number PB-405 marketed by Horton Brasses, Inc. Cromwell, Conn.—four required). Also shown is sixteen flat head cap screws for box hinges 16.

Figure 17:
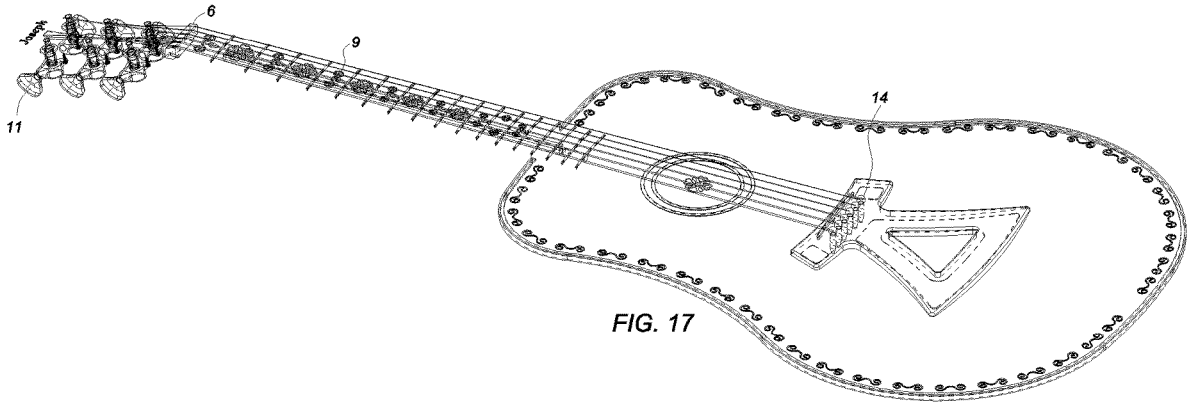
FIG. 17—Miscellaneous components top perspective view from FIG. 1 (sheet 5).
Figure 18:
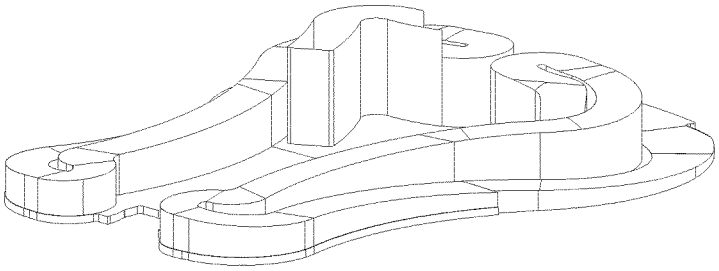
FIG. 18—Four piece chamber dividers bottom perspective view from FIG. 13 (sheet 5)

FIG. 17 (from FIG. 1) shows top perspective view of six string pins 14 (known standard component) that attaches the strings to the bridge 5. Also shown is ninety six pieces of mother of pearl inlay 9, included in fingerboard 4. Also shown is the adjustable nut 6 for clarity. Also shown is six tuning heads 11, which are attached to the neck 3. Drill size, tap size and location will be added to suit, based on actual component brand (known standard component).

I claim:

1. An acoustic guitar, comprising: a back, a side, an internal folded horn, machined from a solid piece of wood to form a guitar body;

an internal chamber divider attached to said guitar body;

an internal speaker, attached mechanically to said guitar body, attached electronically to an internal preamp, an internal electronics package, and an internal microphone;

said internal microphone attached to said internal chamber divider;

said internal preamp attached to said guitar body;

said internal electronics attached to said guitar body;

an elongated neck attached to said guitar body;

a light yet strong soundboard attached to said guitar body;

a bridge attached to said light yet strong soundboard;

an adjustable nut attached to said elongated neck;

an adjustable saddle attached to said bridge;

a guitar string set attached to said bridge, said adjustable saddle, said adjustable nut and said elongated neck;

a back cover and a hinge attached to said guitar body, to hold in place said internal preamp and said internal electronics package.

2. The acoustic guitar of claim 1, wherein said guitar body includes an opening allowing sound to travel from said internal speaker into said internal folded horn.

3. The acoustic guitar of claim 1, wherein said internal chamber divider fits inside said internal folded horn of said guitar body, providing a passage for said sound from said internal speaker, preventing loss of said sound, due to said sound containment through said internal folded horn, to outside environment.

4. The acoustic guitar of claim 1, wherein said internal preamp battery powers said internal electronics package, and is accessible from said back of said acoustic guitar.

5. The acoustic guitar of claim 1, wherein said internal microphone and said internal electronics package provides said sound output through said internal speaker and said internal folded horn.

6. The acoustic guitar of claim 1, wherein said light yet strong soundboard is attached to said guitar body, with an adhesive, comprising: said light yet strong soundboard machined from a solid piece of wood, allowing said light yet strong soundboard to be configured with small but strong ribs, which provides light weight and increased strength, resulting in increased vibration and a greater amount of air displacement, which increases volume.

* * * * *